US006287082B1

(12) United States Patent
Dittmar

(10) Patent No.: US 6,287,082 B1
(45) Date of Patent: Sep. 11, 2001

(54) LIQUID RING PUMP

(75) Inventor: Rudi Dittmar, Helmers (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/462,002

(22) PCT Filed: Jun. 17, 1998

(86) PCT No.: PCT/DE98/01664

§ 371 Date: Dec. 29, 1999

§ 102(e) Date: Dec. 29, 1999

(87) PCT Pub. No.: WO99/01668

PCT Pub. Date: Jan. 14, 1999

(30) Foreign Application Priority Data

Jun. 30, 1998 (DE) ..... 197 27 719

(51) Int. Cl.[7] ..... F04C 19/00

(52) U.S. Cl. ..... 417/68

(58) Field of Search ..... 417/68, 69

(56) References Cited

U.S. PATENT DOCUMENTS

| | | | | |
|---|---|---|---|---|
| 4,443,158 | * | 4/1984 | Bentele et al. | 417/68 |
| 5,100,300 | * | 3/1992 | Haavik | 417/68 |
| 5,197,863 | * | 3/1993 | Dardis | 417/68 |
| 5,211,543 | * | 5/1993 | Siebenwurst | 417/68 |

FOREIGN PATENT DOCUMENTS

| | | |
|---|---|---|
| 316 044 | 11/1919 | (DE) . |
| 41 23 938 | 1/1993 | (DE) . |
| 0 517 277 | 12/1992 | (EP) . |
| 0 645 521 | 3/1995 | (EP) . |
| 2 146 786 | 3/1973 | (FR) . |

* cited by examiner

*Primary Examiner*—Teresa Walberg
*Assistant Examiner*—Vinod D Patel
(74) *Attorney, Agent, or Firm*—BakerBotts LLP

(57) ABSTRACT

A liquid ring pump including at least one drive unit is described, having a drive shaft, a working space housing with an impeller rotating in it and axially freely movable on the drive shaft, and a disk cam with passages in the region of a front face of the drive shaft for an exchange of operating fluid for venting. The passage for the exchange of operating fluid and the axial free mobility have the effect that the impeller adjusts itself during operation.

5 Claims, 1 Drawing Sheet

LIQUID RING PUMP

FIELD OF THE INVENTION

The present invention relates to a liquid ring pump, comprising at least one drive unit, having a drive shaft, and at least one working space housing with an impeller rotating in it and located on the drive shaft, and at least one disk cam with passages for the exchange of operating fluid and for venting, as well as suction and pressure openings.

BACKGROUND INFORMATION

Liquid ring pumps are described in European Patent Nos. 0 517 277 and 0 645 521. Each liquid ring pump includes an overhanging impeller, with which the gap adjustment and axial fastening are performed by means of a screw. These adjustments prove to be very laborious and complicated during installation and repair work and, what is more, a special tool is required for this.

SUMMARY OF THE INVENTION

An object of the present invention is to simplify the operation of axial gap adjustment during both installation and repairs.

The object is successfully achieved by providing an impeller which is axially freely movable on the drive shaft and within the working space housing, even during operation, and by providing a disk cam having in the region of the front face of the drive shaft a passage for the exchange of operating fluid. During operation of the pump, the axial gap between the disk cam and the impeller, as well as between the impeller and the rear side of the pump, sets itself of its own accord on account of the hydraulic conditions. These hydraulic pressure conditions are established as soon as the exchange of operating fluid takes place via the passages in the disk cam in the form of bore holes or annular cutouts opposite the front side of the drive shaft.

DETAILED DESCRIPTION

Figure 1:
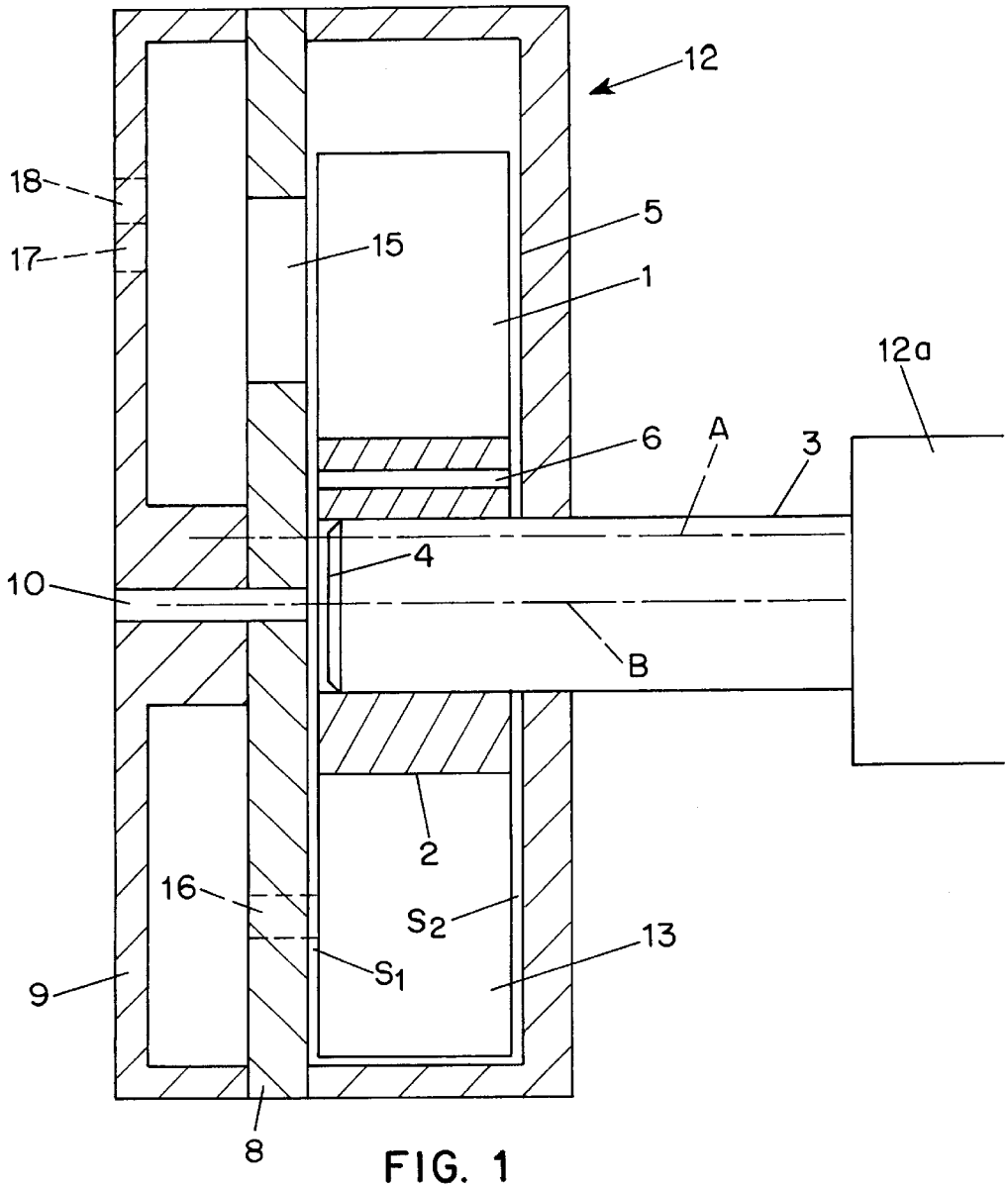
FIG. 1 shows a mini liquid ring vacuum pump.
Figure 2:
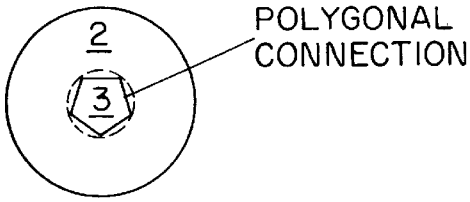
FIGS. 2 and 3 show polygonal and feather key connection, respectively, between a drive shaft and impeller hub.
Figure 3:
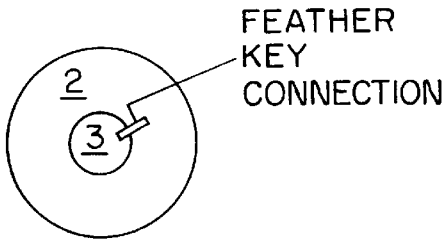

The present invention is explained in more detail with reference to a drawing of a mini liquid ring vacuum pump. The drawing shows in a longitudinal section of a liquid ring pump 12 with an impeller 1, which is located on a drive shaft 3 of a drive unit (not shown), and the cylindrical hub 2 of the impeller.

Opposite the front side 4 of the drive shaft 3 there is a passage 10 arranged in a disk cam 8 and a pump cover 9 for an exchange of operating fluid. Parallel to the drive shaft 3 there are in the hub of the impeller 1 continuous axially parallel bore holes 6. Between the disk cam 8 and the impeller 1, and between the rear side of the pump 5 and the impeller 1, there are the axial gaps S1 and S2, respectively.

By virtue of its design, when this liquid ring pump 12 is in operation these gaps S1 and S2 are set of their own accord on account of the hydraulic pressure conditions. The axially movable impeller 1 has the effect that in both gaps S1 and S2, hydraulic cushions, which are adequate for an axial adjustment of the impeller, are formed. Possible residues of the operating fluid, for example lime, which lead to constriction of the gap and to blocking of the impeller 1, can be removed by edges of the blades 13 of the impeller or the passages 6. Additional edge-forming depressions in the form of blind holes or radial grooves in the region of the hub of the impeller 1 enhance this removing effect.

What is claimed is:

1. A liquid ring pump comprising:

at least one drive unit, having a drive shaft; at least one impeller located on the drive shaft and rotating within a housing, the at least one impeller being axially movable on the drive shaft within the housing during operation; and at least one disk cam having at least one passage there through for the exchange of an operating fluid, the at least one passage being located in the region of the disk cam substantially opposite the front face of the drive shaft.

2. The liquid ring pump according to claim 1 wherein the disk cam is further formed with at least one opening for pressure and at least one opening for suction.

3. The liquid ring pump according to claim 1 wherein the impeller is formed with a hub which is connected to the drive shaft via a connection means selected from the group consisting of a polygonal connection and a feather key connection.

4. A liquid ring pump according to claim 1 wherein the at least one passage for the exchange of an operating fluid is selected from the group consisting of an annular cutout and a bore hole.

5. The liquid ring pump according to claim 1 wherein the impeller hub has at least one axially parallel bore hole which communicates with the impeller housing.

* * * * *